United States Patent [19]

Witting

[11] Patent Number: 4,890,042

[45] Date of Patent: Dec. 26, 1989

[54] HIGH EFFICACY ELECTRODELESS HIGH INTENSITY DISCHARGE LAMP EXHIBITING EASY STARTING

[75] Inventor: Harald L. Witting, Burnt Hills, N.Y.

[73] Assignee: General Electric Company, Schenectady, N.Y.

[21] Appl. No.: 202,737

[22] Filed: Jun. 3, 1988

[51] Int. Cl.[4] ..... H05B 41/16

[52] U.S. Cl. ..... 315/248; 313/492; 313/642; 313/607

[58] Field of Search ..... 315/248, 267, 57, 344, 315/348, 85; 313/642, 643, 639, 492, 607

[56] References Cited

U.S. PATENT DOCUMENTS

| | | | |
|---|---|---|---|
| 3,248,548 | 4/1966 | Booth et al. | 315/248 |
| 3,763,392 | 10/1973 | Hollister | 313/607 |
| 3,860,854 | 1/1975 | Hollister | 313/607 |
| 4,422,011 | 12/1983 | Puesen et al. | 313/642 |
| 4,480,213 | 10/1984 | Lapatovich et al. | 315/248 |
| 4,568,859 | 2/1986 | Houkes et al. | 313/492 |

*Primary Examiner*—Leo H. Boudreau
*Assistant Examiner*—Michael Razavi
*Attorney, Agent, or Firm*—Jill M. Breedlove; James C. Davis, Jr.; Marvin Snyder

[57] ABSTRACT

Improved ease of starting at room temperature while maintaining high efficacy and good color rendition at white color temperatures is achieved in an electrodeless metal halide high intensity discharge lamp wherein a mercury-free combination of arc tube fill materials may include sodium iodide with or without cerium halide, and either krypton or argon as a starting gas.

14 Claims, 1 Drawing Sheet

HIGH EFFICACY ELECTRODELESS HIGH INTENSITY DISCHARGE LAMP EXHIBITING EASY STARTING

RELATED PATENT APPLICATIONS

In Dakin and Johnson U.S. patent application Ser. No. 676,367, filed Nov. 29, 1984, and assigned to the assignee of the present invention, now abandoned an electrode type lamp utilizing sodium iodide and xenon buffer gas as the arc tube fill material is disclosed. In that application it is recognized that xenon buffer gas exerts a favorable influence on the sodium D-line spectrum and also prevents the tie-up of halide which occurs in prior art lamps when a mercury buffer gas is employed.

In Dakin, Anderson and Battacharya U.S. Pat. No. 4,783,615, issued Nov. 8, 1988, now U.S. Pat. No. 4,783,615, issued Nov. 11, 1988, and also assigned to the present assignee, an electrodeless type sodium iodide arc lamp is disclosed wherein the arc tube fill comprises sodium iodide, mercury iodide, and xenon in a sufficient quantity to limit chemical transport of energy from the plasma discharge to the walls of said arc tube. In the arc tube fill, the mercury iodide is present in a quantity less than the quantity of sodium iodide but sufficient to provide an amount of free iodine near the arc tube walls when the lamp is operating. The sodium iodide in the arc tube fill can also be present in sufficient quantity to provide a reservoir of condensate during lamp operation.

In Johnson, Dakin and Anderson U.S. Pat. No. 4,810,938, issued Mar. 7, 1989, and assigned to the present assignee, an electrodeless type high intensity discharge lamp is disclosed wherein a mercury-free arc tube fill comprises sodium halide, cerium halide in weight proportion no greater than the weight proportion of sodium halide in the fill, and a reservoir of these fill materials in the arc tube to compensate for any loss of the individual constituents during lamp operation. High pressure xenon buffer gas is present in sufficient quantity to limit the transport of thermal energy by conduction from the arc discharge to the walls of the arc tube, as well as to function as a starting gas.

Since the present invention represents still further improvements in the electrodeless form of the aforementioned high intensity discharge metal halide lamp and employs some of the same arc tube materials, all three of the aforementioned co-pending patent applications are specifically incorporated herein by reference.

BACKGROUND OF THE INVENTION

This invention relates generally to high intensity discharge lamps wherein the arc discharge is generated by a plasma in a solenoidal electric field and more particularly to use of a new buffer gas employed in the arc tube fill in combination with sodium iodide or the combination of sodium iodide and cerium halide to improve starting performance without adversely affecting lamp efficacy or color rendition. Lamp efficiency or "efficacy", as used in the present application, means luminous efficacy as measured in conventional terms of lumens per watt. As to color rendition, general purpose illumination requires that objects illuminated by a particular light source display much the same color as when illuminated by natural sunlight. Such requirement is measured by known standards such as the C.I.E. color rendering index values (CRI), and CRI values of 50 or greater are deemed essential for commercial acceptability of lamps in most general lighting applications. A still further requirement for commercially acceptable general purpose illumination is the white color temperature provided with such lamp, which is fixed at about 3000°K for the warm white lamp, about 3500°K for the standard white lamp and about 4200°K for the cool white lamp, as measured by the C.I.E. chromaticity x and y values.

The lamps described in the present invention are part of the class referred to as high intensity discharge lamps (HID) because in their basic operation a medium to high pressure gas is caused to emit visible wavelength radiation upon excitation typically caused by passage of current through an ionizable gas such as sodium vapor or mixed sodium vapor and cerium vapor. The original class of such HID lamps was that in which the discharge current was caused to flow between a pair of electrodes. Since the electrode members in such electroded HID lamps were prone to vigorous attack by the arc tube fill materials, causing early lamp failure, the more recently developed solenoidal electric field lamps of this type have been proposed to broaden the choice of arc tube materials through elimination of the electrode component. Such more recently developed solenoidal electric field lamps are described in J.M. Anderson U.S. Pat. Nos. 4,017,764 and 4,180,763, and Chalek and Johnson U.S. Pat. No. 4,591,759, all assigned to the assignee of the present invention, and generate a plasma arc in the arc tube component during lamp operation, all in a previously known manner.

Conventional electrodeless HID lamps suffer from the disadvantage that they are difficult to start. This is because the xenon buffer gas also functions as the starting gas. However, xenon is difficult to start, especially when used at a high pressure, such as 200 torr, as compared with the more conventional starting gas pressures of 30 torr or less. The difficulty of starting high-pressure xenon, combined with the low solenoidal electric field available from the lamp induction coil, has heretofore made room temperature HID lamp starting impossible.

One method that has been used for starting HID lamps involves immersing the arc tube in liquid nitrogen so as to condense most of the xenon. Thereafter, the induction coil current is increased, and the lamp usually starts at a current of 18 amps or less. If necessary, a spark coil is used to apply high-voltage pulses to help start the discharge. Once the lamp is started, heat from the discharge evaporates the condensed xenon and normal xenon pressure is reached.

The liquid nitrogen method is effective because there is an optimum xenon pressure for starting the discharge. While this optimum pressure is not known with great precision for the above stated starting conditions, it is nevertheless well below 200 torr and above the saturation vapor pressure of xenon (2.5 millitorr) at the temperature of liquid nitrogen (77°K). Since the liquid nitrogen starting method is clearly not practical for commercial lamps, it is desirable to employ a more practical starting method for room-temperature operated HID lamps.

OBJECTS OF THE INVENTION

One object of the invention is to buffer chemical transport of energy from the plasma arc to the arc tube walls in an electrodeless sodium iodide or sodium iodide/cerium halide arc discharge lamp with krypton starting gas.

Another object of the invention is to buffer chemical transport of energy from the plasma arc to the arc tube walls in an electrodeless sodium iodide or sodium iodide/cerium halide arc discharge lamp with argon starting gas.

Another object of the invention is to improve the ease of starting an electrodeless arc discharge lamp while maintaining high efficacy and good color rendition.

Still another object of the invention is to optimize the starting and operating performance of an electrodeless sodium iodide or sodium iodide/cerium halide arc lamp at room temperature.

SUMMARY OF THE INVENTION

In accordance with the invention, a particular combination of fill materials in the arc tube of an electrodeless metal halide arc lamp is used to provide white color lamp emission at improved efficacy and color rendition, accompanied by reliable starting in a room temperature ambient. More particularly, this improved lamp features a light transmissive arc tube containing a mercury-free fill comprising sodium iodide or a mixture of sodium iodide and cerium halide, along with either krypton gas or argon gas in the proper weight proportion to generate white color lamp emission at an efficacy of 200 lumens per watt (LPW) or greater and accompanied by color rendering indices (CRI) of at least 50. The white color temperature for the improved lamps extends from about 3000° K up to about 5000° K so that such lamps are suitable for general illumination purposes. Useful cerium halides in the sodium iodide/cerium halide mixture employed as the lamp fill can be selected from the group consisting of chlorides and iodides, including mixtures thereof such as cerium chloride ($CeCl_3$) and cerium iodide ($CeI_3$). The weight proportion of cerium halide is maintained no greater than the weight proportion of sodium iodide in the fill in order to provide the aforementioned characteristics, with a reservoir of these fill materials in the arc tube being desirable to compensate for any loss of the individual constituents during lamp operation. With respect to the relative weight proportions of the aforementioned sodium iodide and cerium halide mixture, it has been found that too much sodium iodide lowers CRI values whereas too much cerium halide lowers lamp efficacy. The composite white color lamp emission provided with the aforementioned mixture of fill materials results mainly from otherwise conventional high pressure sodium discharge emission to which has been added visible radiation provided by cerium halide which extends in a continuous manner over the 400–700 nanometer visible wavelength region.

The improvement in starting is attributable to maintaining controlled proportions of krypton gas or argon gas in the lamp fill. Specifically, the replacement of xenon with krypton or argon at high pressures allows the krypton or argon to serve as a barrier or buffer against undesirable transport of thermal energy from the arc discharge to the arc tube walls so as to preserve the efficacious radiation output and other benefits attainable when utilizing xenon as both a buffer gas and a starting gas, while at the same time rendering room temperature starting of the lamp easier and more reliable.

The amount of krypton or argon employed in the present arc tube fill to achieve the above noted lamp starting performance gains must be sufficient to provide a partial pressure in the range of about 100–500 torr at room temperature.

A preferred lamp structural configuration utilizing the above disclosed arc tube materials to optimize lamp starting performance features a cylindrically-shaped arc tube of a height less than its outside diameter, a light transmissive outer envelope disposed around the arc tube and defining a space therebetween, and excitation means for coupling radio-frequency energy to the arc tube fill. The arc tube is preferably formed of a high temperature glass, such as fused quartz, or an optically transparent ceramic, such as polycrystalline alumina. A plasma arc is generated inside the filled arc tube during lamp operation by excitation from a solenoidal electric field associated with the lamp, all in known manner. The excitation is created by a magnetic field, changing with time, to establish within the tube an electric field which closes completely upon itself, resulting in the light-producing high intensity discharge. The excitation source in the preferred lamp design comprises an induction coil disposed around the outside of the outer lamp envelope and connected to a power supply through an impedance matching network. The spacing between the arc tube and outer envelope in the preferred lamp device can be occupied by thermal energy barrier means, such as metal baffles or quartz wool, or even a vacuum. Such thermal barrier means desirably reduces heat loss from the lamp.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

DETAILED DESCRIPTION OF THE PREFERRED EMBODIMENT

Figure 1:
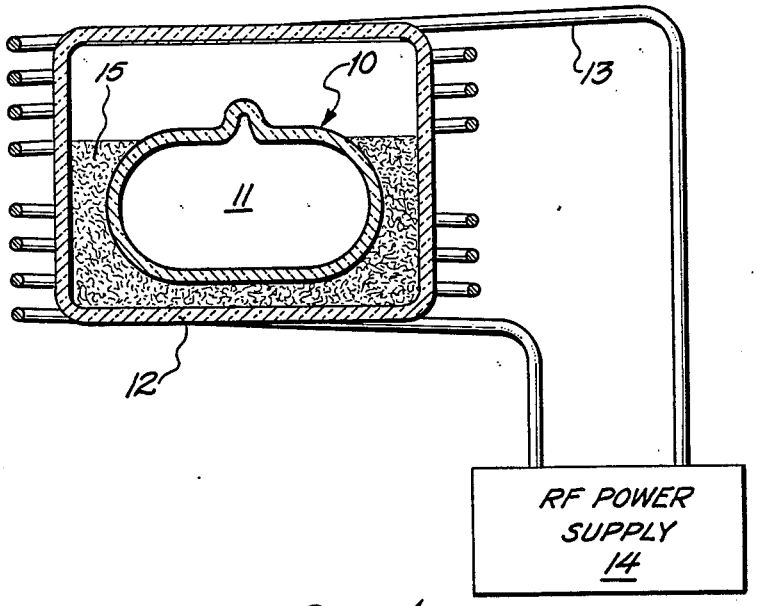
FIG. 1 is a cross-sectional side view depicting an electrodeless lamp configuration of the present invention together with apparatus for exciting the lamp fill.

FIG. 1 depicts an electrodeless arc discharge lamp which includes an arc tube 10 for containing a fill 11. Arc tube 10 comprises a light-transmissive material, such as fused quartz or a refractory ceramic material such as sintered polycrystalline alumina. An optimum shape for arc tube 10, as depicted, is a flattened spherical shape or a short cylindrical (e.g. hockey puck or pillbox) shape with rounded edges. The diameter of arc tube 10 is greater than its height dimension. A light-transmissive outer envelope 12, which may be comprised of quartz or a refractory ceramic, is disposed around arc tube 10. Convective cooling of arc tube 10 is limited by outer envelope 12. A blanket of quartz wool 15 may also be provided between arc tube 10 and outer envelope 12 at the bottom and sides of the arc tube to further limit cooling. Quartz wool 15 is comprised of thin fibers of quartz which are nearly transparent to visible light but which diffusely reflect infrared radiation.

A primary coil 13 and a radio-frequency (RF) power supply 14 are employed to excite a plasma arc discharge in fill 11. As previously indicated, this configuration including primary 13 and RF power supply 14 is commonly referred to as a high intensity discharge solenoidal electric field (HID-SEF) lamp. The SEF configuration is essentially a transformer which couples radio-frequency energy to a plasma, the plasma acting as a single-turn secondary for the transformer. An alternating magnetic field which results from the RF current in primary coil 13 creates an electric field in arc tube 10 which closes upon itself completely. Current flows as a result of the electric field and an arc discharge results in arc tube 10. Since a more detailed description for such HID-SEF lamp structures is found in previously cited U.S. Pat. Nos. 4,017,764 and 4,180,763, the disclosures of both are hereby specifically incorporated by reference. An exemplary frequency of operation for RF power supply 14 is 13.56 megahertz. Typical power input to the lamp can be in the range of 100–2000 watts.

Figure 2:
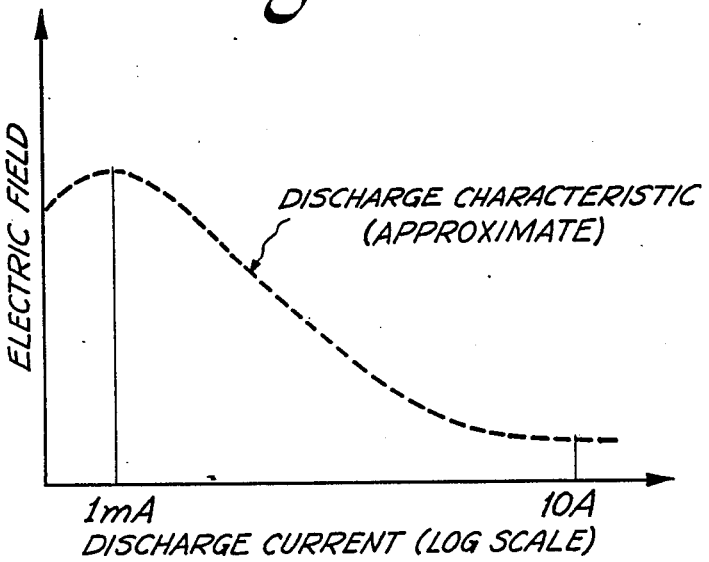
FIG. 2 is a graphical depiction of the approximate discharge current-voltage characteristic for xenon at 200 torr.

The problem of starting an electrodeless HID lamp employing xenon as a starting gas is illustrated by the curve shown in FIG. 2. As the initial discharge current increases from zero, much higher electric fields have to be applied to the discharge than during steady state operation, where sodium iodide or sodium iodide/-cerium iodide electrodeless lamps operate at discharge levels of approximately 10 amps and 10 volts per centimeter. After the discharge current has increased above approximately 1 milliamp, the electric field necessary to sustain the arc discharge decreases to a value well below that needed to initiate the discharge. While the discharge characteristic for xenon at 200 torr is not known accurately, tests have shown that the electric field required for starting is higher than what can be obtained from an electromagnetic induction coil of reasonable size and power loading. For example, using an arc tube such as shown in FIG. 1 with a 20 millimeter outside diameter and 17 millimeter outer height, an induction coil made from ⅛" diameter copper tubing with seven turns, a central opening of 26 millimeters in diameter and an impedance of 145 ohms at 13.56 MHz can produce a solenoidal electric field in the discharge region of approximately 20 volts per centimeter at the maximum safe coil current of 18 amps. This field is too low to start the electrodeless lamp with a xenon buffer gas in the fill.

The following examples are provided to demonstrate other, successfully tested arc tube fills for the present metal halide arc lamp. In all five examples, the arc tube had a rounded cylindrical shape, with a 20 millimeter outside diameter and 17 millimeter outer height.

EXAMPLE I

An arc tube was filled with 4.0 milligrams NaI, 2.0 milligrams $CeI_3$, and approximately 250 torr partial pressure of krypton gas at room temperature. The lamp started at room temperature and operated at approximately 218 watts input power to produce 207 LPW and a 52 CRI value.

EXAMPLE II

An arc tube was filed with approximately 3.8 milligrams NaI, 2.0 milligrams $CeI_3$, and 250 torr partial pressure of krypton gas at room temperature. The lamp started at room temperature and operated at approximately 243 watts input power to provide 198 LPW efficacy and a 54 CRI value.

For purposes of comparing normal operation of the lamps having a krypton starting gas, the following three examples were performed using xenon as the starting gas.

EXAMPLE III

In this example, the arc tube fill consisted of approximately 6.3 milligrams NaI and 2.8 milligrams $CeI_3$ along with xenon gas at a partial pressure of approximately 250 torr at room temperature. When supplied with 244 watts input power, the lamp exhibited 202 LPW and a 50 CRI value.

EXAMPLE IV

An arc tube was filled with 6.5 milligrams NaI, 3.1 milligrams $CeCl_3$, and 500 torr partial pressure of xenon at room temperature. At 260 watts input power the lamp produced 205 LPW and a 51 CRI value.

EXAMPLE V

An arc tube was filled with approximately 6.0 milligrams NaI, 2.3 milligrams $CeCl_3$, and 500 torr partial pressure of xenon at room temperature. When operated at 265 watts input power, the lamp produced 203 LPW at a 54 CRI value.

As to ease of starting, three lamp fills were tested in an arc tube comprised of a rounded cylinder of fused quartz having an outside diameter of 20 millimeters and an outside height of 17 millimeters. The lamp fills all contained 6 milligrams NaI, 3 milligrams $CeI_3$ and a starting gas of either xenon or krypton.

Five turns of copper bar (2.5 x 3.8 millimeters) were wound to form a solenoid of 20 millimeters bore to fit the arc tubes fairly tightly. A spark coil was used to provide the initial ionization. Current in the induction coil was gradually raised while observing the arc tube. The current levels were recorded at which a sustained glow discharge and the full high-current SEF mode appeared. The results for three lamps are as follows:

| Lamp No. | Inert Gas | Gas Pressure | Coil Current for Sustained Glow Mode | Coil Current for SEF Mode |
|---|---|---|---|---|
| W-73 | xenon | 250 torr | 28 amps | 28 amps |
| W-72 | xenon | 500 torr | 35 amps | 35 amps |
| W-75 | krypton | 500 torr | 28 amps | 29 amps |

Thus it is evident that for the two xenon-containing lamps, starting was easier at 250 torr than at 500 torr; however, the higher pressure (500 torr) krypton-containing lamp was easier to start than the 500 torr xenon-containing lamp, reducing the current level required in the induction coil for lamp starting from 35 amps to 29 amps.

Finally, an electrodeless lamp of rounded cylindrical shape and comprised of fused quartz having an outside diameter of 20 millimeters and an outside height of 17 millimeters was filled with 6 milligrams NaI, 3 milligrams $CeI_3$ and argon starting gas at 250 torr partial pressure. Although this lamp started even easier than comparable krypton-containing lamps, its efficacy was approximately 10% lower than that of similar krypton-containing or xenon-containing lamps. Hence argon can be employed to provide easier starting than krypton, but with a reduction in efficacy as a trade-off.

Thus HID lamps of the new type herein described can be started into the full SEF mode without use of liquid nitrogen or of internal starting probes, and without adverse effect on lamp operation, at coil currents significantly below those required for starting HID lamps employing xenon as a buffer gas (and also a starting gas).

The HID-SEF lamps of the present invention thus exhibit optimum performance when containing the combination of arc tube fill materials including sodium iodide, with or without, cerium halide, and with either krypton or argon starting gas. As has been shown, efficacy of over 200 LPW is obtained, accompanied by CRI values of 50 or greater.

The foregoing describes a broadly useful, improved HID electrodeless lamp exhibiting superior starting performance without adverse effect on normal operation. The invention is relevant to fills including sodium iodide, or a mixture of sodium iodide and cerium halide, as a starting gas.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

I claim:

1. A mercury-free electrodeless metal halide arc lamp comprising:

a light transmissive arc tube for containing an arc discharge;

a fill disposed in said arc tube to generate said arc discharge, said fill including sodium iodide and a gas selected from the group consisting of krypton and argon in a quantity sufficient to provide a partial pressure in the range of about 100-500 torr at room temperature so as to limit the transport of thermal energy from said arc discharge to the walls of said arc tube; said fill further comprises cerium halide, said halide being selected from the group consisting of chlorides and iodides, said sodium iodide and said cerium halide being present in weight proportions to generate white color lamp emission, wherein the weight proportion of cerium halide is not greater than the weight proportion of sodium iodide and excitation means for coupling radio-frequency energy to said fill.

2. The lamp of claim 1 wherein the selected gas is krypton.

3. The lamp of claim 1 wherein the selected gas is argon.

4. The lamp of claim 3 wherein an amount of sodium iodide is selected so that a reservoir of sodium iodide condensate is present during lamp operation.

5. The lamp of claim 3 wherein an amount of cerium halide is selected so that a reservoir of cerium halide condensate is present during lamp operation.

6. The lamp of claim 3 wherein the selected amounts of both sodium iodide and cerium halide provide a reservoir of mixed condensates during lamp operation.

7. The lamp of claim 3 wherein the selected gas is krypton.

8. The lamp of claim 3 wherein the selected gas is argon.

9. The lamp of claim 7 wherein the selected cerium halide is cerium iodide.

10. The lamp of claim 7 wherein the selected cerium halide is cerium chloride.

11. The lamp of claim 8 wherein the selected cerium halide is cerium chloride.

12. The lamp of claim 8 wherein the selected cerium halide is cerium chloride.

13. A mercury-free electrodeless metal halide arc lamp comprising:

a light transmissive arc tube for containing an arc discharge, said arc tube being cylindrically-shaped with the height of said arc tube being less than its outside diameter;

a light transmissive outer envelope disposed around said arc tube and defining a space therebetween; wherein the space between the light transmissive outer envelope and said arc tube is occupied with thermal energy barrier means a fill disposed in said arc tube to generate said arc discharge, said fill including sodium iodide and cerium halide, said halide being selected from the group consisting of chlorides and iodides, said sodium iodide and cerium halide being present in weight proportions to generate white color lamp emission;

said fill further including a gas selected from the group consisting of krypton and argon in a sufficient quantity to provide a partial pressure in the range of about 100–500 torr at room temperature; and excitation means for coupling radio-frequency energy to said fill.

14. The lamp of claim 13 wherein the space between the light transmissive outer envelope and said arc tube is evacuated.

* * * * *